United States Patent [19]

Borichevsky

[11] Patent Number: 4,467,730

[45] Date of Patent: Aug. 28, 1984

[54] TABLE WITH RELEASABLE TOP

[75] Inventor: Donald J. Borichevsky, Rutland County, Vt.

[73] Assignee: The Telescope Folding Furniture Co. Inc., Granville, N.Y.

[21] Appl. No.: 337,083

[22] Filed: Jan. 4, 1982

[51] Int. Cl.[3] ..... A47B 3/06

[52] U.S. Cl. ..... 108/159; 108/153; 108/157

[58] Field of Search ..... 108/159, 157, 153, 155, 108/161; 220/84, 80; 52/822, 830

[56] References Cited

U.S. PATENT DOCUMENTS

| | | | |
|---|---|---|---|
| 897,414 | 9/1908 | Sanders | 52/822 |
| 936,451 | 10/1909 | Havenhill | 220/84 |
| 1,273,207 | 7/1918 | Wege | 108/161 |
| 1,770,293 | 7/1930 | Bergmann | 52/822 |
| 1,885,805 | 11/1932 | Dawson | 52/822 |
| 1,911,779 | 5/1933 | Uhl | 52/822 |
| 2,477,682 | 8/1949 | Ball | 52/822 |
| 2,644,602 | 7/1953 | Ross | 220/80 |
| 3,912,210 | 10/1975 | von Bohr | 108/159 |
| 4,112,855 | 9/1978 | Colby | 108/159 |
| 4,216,729 | 8/1980 | Schrader | 108/159 |
| 4,399,754 | 8/1983 | Emery | 108/159 |

*Primary Examiner*—William E. Lyddane
*Assistant Examiner*—Mark W. Binder
*Attorney, Agent, or Firm*—Kenyon & Kenyon

[57] ABSTRACT

The table is constructed with a rigid frame and a top which can be snapped into place in the frame. The frame is provided with recesses along the cross-bars of the U-shaped leg frames in order to receive the table top. Each recess is associated with an overhanging lip which holds the table top in place.

13 Claims, 6 Drawing Figures

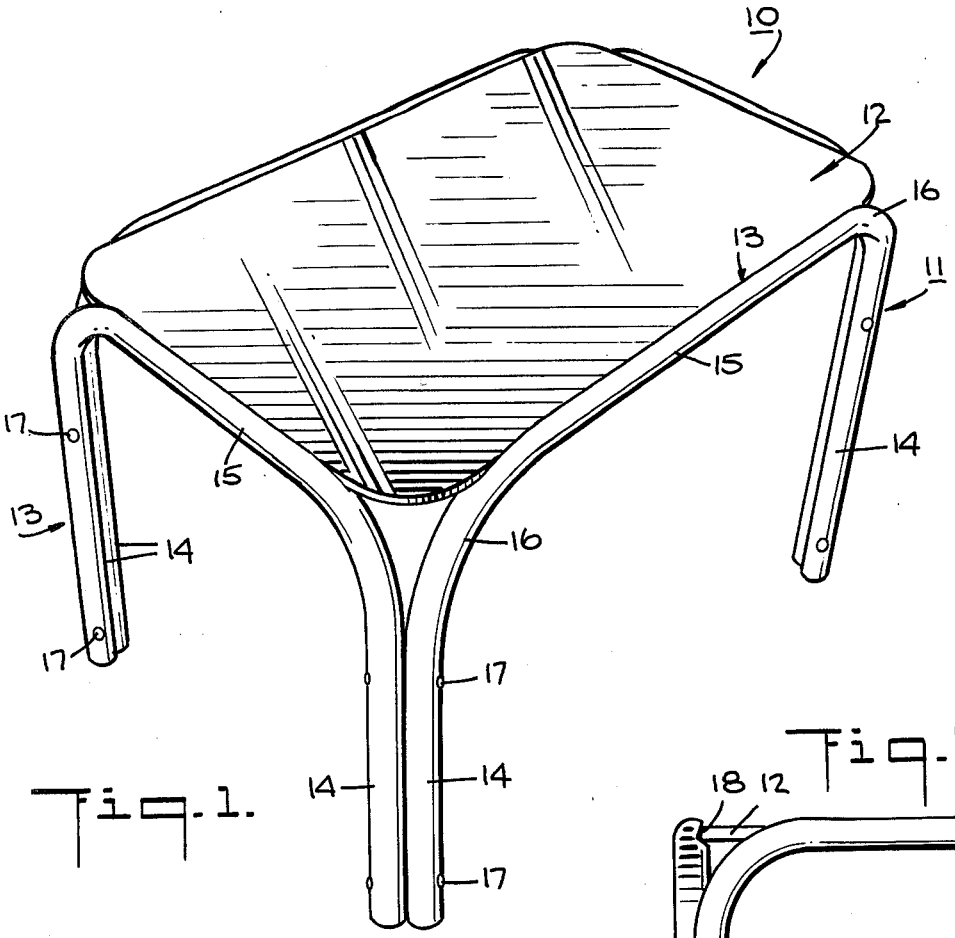
Fig. 1.
Fig. 3.
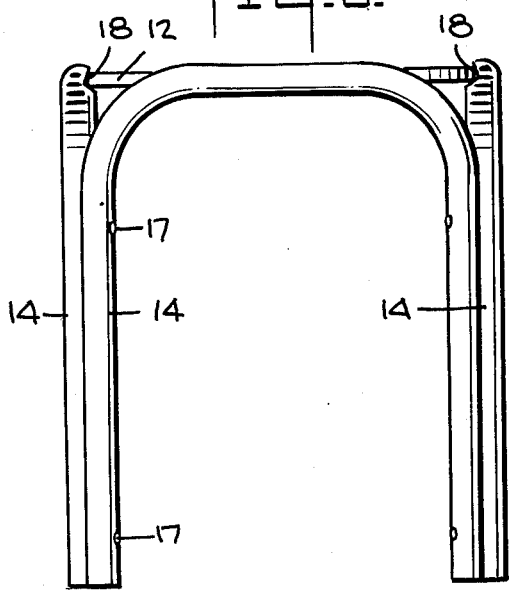
Fig. 2.
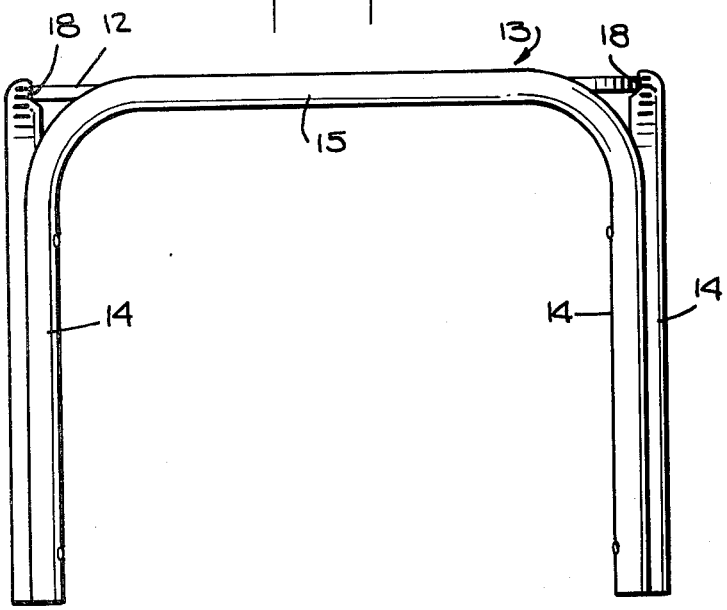
Fig. 6.
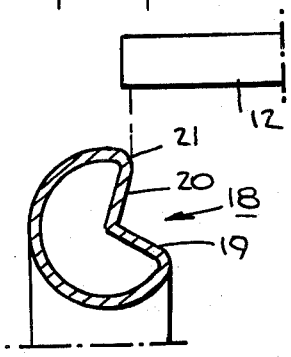

TABLE WITH RELEASABLE TOP

This invention relates to a table. More particularly, this invention relates to a table for outdoor use.

As is known, various types of tables have been constructed for outdoor use, and particularly for use in warm weather. Generally, these tables are not used during the colder seasons of the year, but are placed in storage. Because of this seasonal use, the tables have required a construction which permits easy storage and subsequent re-assembly. For example, these tables have frequently been provided with pivotal or collapsible leg assemblies as well as removable tops which permit folding of the tables into flattened shapes. However, in some cases, the structural aspects which permit collapsing of the tables have limited the configuration of the table and, thus, the aesthetic appearance of the table when in use. In still other cases, mechanical fasteners and tools have been required in order to knock-down and to thereafter re-assemble the tables.

Accordingly, it is an object of the invention to provide a table for outdoor use which can be readily assembled and knockeddown for storage.

It is another object of the invention to provide a table which can be knocked-down and re-assembled without using mechanical fasteners and tools.

It is another object of the invention to proivde a table of attractive appearance which can be disassembled for storage purposes.

Briefly, the invention provides a table which is comprised of a plurality of leg frames at least some of which have a horizontal cross-bar including a longitudinally disposed recess with an overhanging lip and a table top having a peripheral edge releasably received in the recesses of the cross-bars.

The leg frames are constructed to define a rigid skeletal frame for receiving the table top in a secure manner. In addition, the construction of the skeletal frame is such that the table top can be sprung into place within the recesses of the cross-bars of the leg frames when assembling the table. Likewise, in order to knock-down, i.e., disassemble the table, the top can be removed in a similar manner by imposing a manually applied force from below. The recesses which receive and hold the table top are each formed by a deformed section of a cross-bar of each leg frame. To this end, each recess has a downwardly directed bottom wall and an upwardly directed top wall which defines the lip which overhangs the edge of the table top when received in the recess so as to hold the table top securely in place.

In order to allow the legs to spring, the frames are fastened to each other near the bottom and at about two-thirds the height of the leg frames.

These and other objects and advantages of the invention will become more apparent from the following description taken in conjunction with the accompanying drawings wherein:

FIG. 1 illustrates a perspective view of a table construed in accordance with the invention;

FIG. 2 illustrates a front view of the table of FIG. 1;

FIG. 3 illustrates a side view of the table of FIG. 1;

FIG. 6 illustrates a fragmentary cross-sectional view of a table top and cross-bar of the table.

Figure 4:
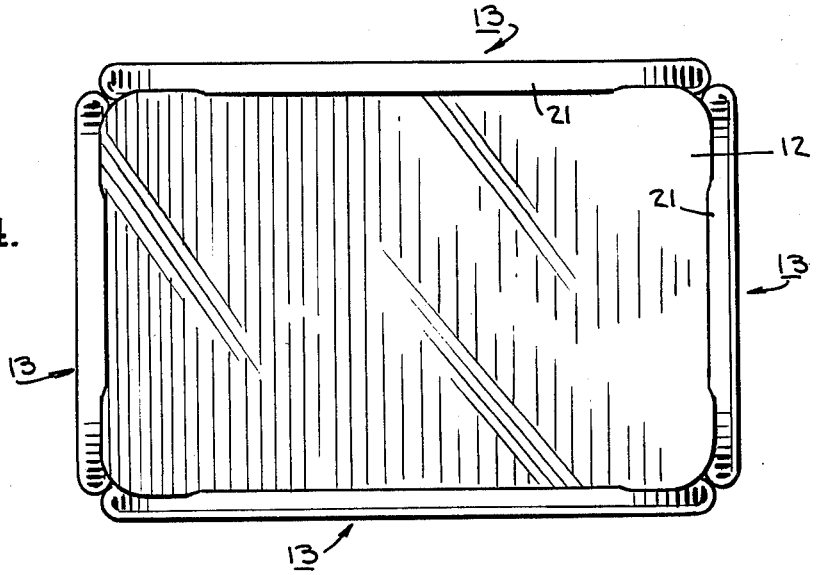
FIG. 4 illustrates a top view of the table of FIG. 1.

Referring to FIG. 1, the table 10 includes a leg frame assembly 11 and a table top 12. As indicated, the leg assembly 11 is formed of a plurality of U-shaped leg frames 13 which are secured together to form a rectangular shape. Each leg frame 13 includes two depending legs 14 and a horizontal cross-bar 15 interconnecting the legs 14. For example, each leg frame 13 is formed of a one-piece hollow metal tube, such as an aluminum tube, and is bent between the legs 14 and the cross-bar 15 into curvilinear shaped corners 16.

Of note, the legs 14 may have a slightly greater diameter than the bent corner portions 16 and the cross-bar 15.

Each leg frame 13 is secured to an adjacent leg frame 13 in a rigid manner, for example, via two rivets 17 to form a rigid self-standing skeletal frame. As shown in FIG. 1, one rivet 17 is disposed near the bottom of the frame while the second rivet 17 is located about two-thirds the height of the table. Alternatively, the leg frame 13 may be secured together by welding.

Figure 5:
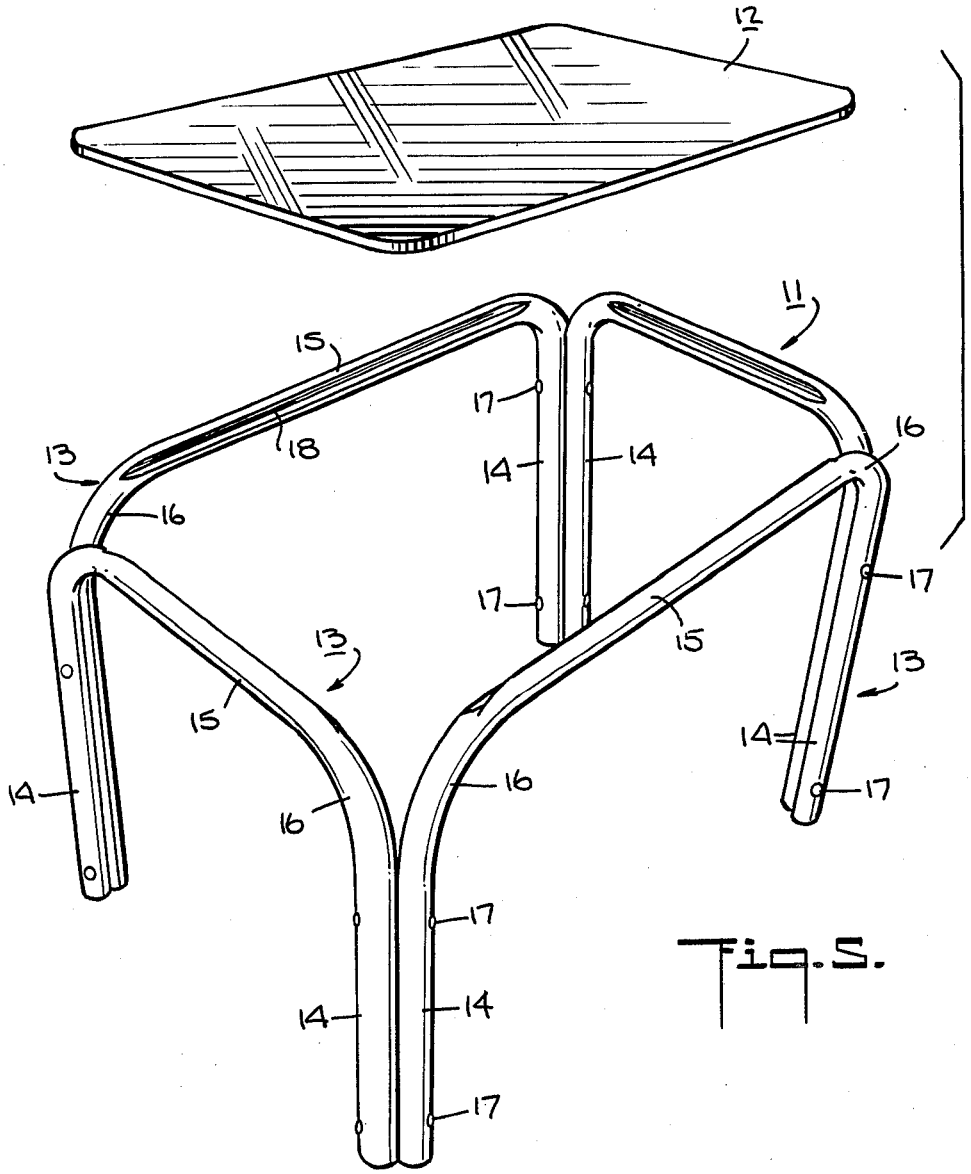
FIG. 5 illustrates an exploded view of the table of FIG. 1.

Referring to FIGS. 5 and 6, each cross-bar 15 is deformed to have a longitudinally disposed recess 18 extending between the bent corners 16. As indicated in FIG. 6, each recess 18 has a downwardly directed bottom wall 19 and an upwardly directed top wall 20. The two walls 19, 20 are disposed in angular relationship with each other with the bottom wall defining an angle of about 25° with respect to the horizontal. The top wall 20 also has a lip 21 which overhangs the recess 18. As indicated in FIG. 6, the recess 18 extends inwardly so that the apex defined by the bottom wall 19 and the top wall 20 is spaced from the axis of the cross-bar 15 on the side of the recess 18. The horizontal distance from the vertex of the angle defined by the bottom wall 19 and the top wall 20 to the lip 21 may be, for example, one-half inch for a one inch diameter tube.

The bottom ends of the legs may be provided with suitable inserts (not shown), such as plastic plugs, to close the ends and provide a foot for sliding of the table 10.

Referring to FIG. 5, the table top 12 is made of one piece in a rectangular shape with rounded corners. As shown in FIGS. 2 and 3, the table top 12 fits into the recesses 18 of the leg frames 13. When in place, the table top 12 is located below the plane of the top surfaces of the leg frames 13 and is held in place by the overhanging lips 21 of each of the cross-bars 15.

The table top 12 can be made of any suitable material such as a flat transparent plastic. The top is of sufficient thickness to be self-supporting over the extent of the space defined by the leg frames 13. As indicated in FIGS. 1 and 4, the rounded corners of the table top 12 project into the areas above the junctures of the leg frames 13. Also, as shown in FIGS. 2 and 3, the length and width of the top 12 is such as to extend between two opposite cross-bars 15 with the lips 21 of the cross-bars 15 overhanging the top 12.

In order to assemble the table 10, the skeletal leg frame assembly 11 is placed in an upstanding manner. Thereafter, the table top 12 is inserted into a recess 18 in one leg frame 13 and then snapped into place into the remaining three recesses. In this regard, the leg frames 13 spring apart slightly to permit entry of the table top 12 into the recesses 18.

In order to disassemble the table, a slight manual force is applied to the bottom of the table top 12 along one edge so as to push the edge out of a recess 18. This, in turn, causes the table top 12 to pivot about the opposite recess while lifting out of the other recesses.

Apart from the rivets 17, the table 10 can be constructed without any further mechanical fasteners. As a result, the table can be manufactured in an inexpensive manner. Further, when the table is to be disassembled for storage purposes by a user, the table top can be readily stored in a protective manner to prevent scratching or marring of the surface. The remaining skeletal leg frame can also be stored in a suitable manner without need to be concerned with the table top 12.

The invention thus provides a table which has an aesthetically pleasing shape and which provides a large table top area of stable construction. Because of the rectangular shape, the table can avoid tipping.

Fruther, the invention provides a table which can be manufactured in a simple rapid manner with a minimum of tools and labor. As a result, a low-cost aesthetically pleasing table can be provided to the ultimate user.

The table may be of a rectangular, as illustrated, or any other suitable shape such as a square shape.

The invention further provides a table which is inexpensive to manufacture and which has a top which is replaceable, which is removable for cleaning, which is aesthetically pleasing and which will not fall out in use. Further, when storing the table, the table can be turned sideways or hanged in a depending condition without the top falling out of place.

What is claimed is:

1. A table comprising a plurality of leg frames, at least two opposed leg frames having a horizontal tubular cross-bar deformed to define a longitudinally disposed recess with an overhanging lip along an upper edge of said recess and being adapted to spring apart from each other; and a table top having a peripheral edge snap-fitted in said recesses of said cross-bars with each lip of a respective cross-bar overhanging and peripheral edge of said table top.

2. A table as set forth in claim 1 wherein said leg frames define a rigid skeletal frame.

3. A table as set forth in claim 2 wherein each leg frame is a U-shaped tubular metal frame.

4. A table as set forth in claim 3 wherein each recess has a downwardly directed bottom wall and an upwardly directed top wall, said top wall having said lip therein.

5. A table as set forth in claim 4 wherein said bottom wall is directed downwardly from a horizontal plane at an angle of 25 degrees.

6. A table as set forth in claim 3 wherein each leg frame is secured to an adjacent leg frame adjacent a lower end of a leg thereof and at about two-thirds the height of said leg to permit springing of said leg frames.

7. A table as set forth in claim 1 wherein said table top is flat.

8. A table comprising a plurality of U-shaped leg frames defining a rectangular shape, and being adapted to spring apart from each other, each said leg frame including a horizontal tubular cross-bar deformed to define a longitudinally disposed recess therein with an overhanging lip along an upper edge, and a rectangular table top supported on each said cross-bar, said table top having a peripheral edge snap-fitted in said recesses of said cross-bars with said lips overhanging said peripheral edge of said table top to hold said table top in place.

9. A table as set forth in claim 8 wherein each recess has a downwardly directed bottom wall and an upwardly directed top wall, said top wall having said lip thereon.

10. A table as set forth in claim 9 wherein said bottom wall is directed downwardly from a horizontal plane at an angle of 25 degrees.

11. A table as set forth in claim 8 wherein each leg frame is secured to an adjacent leg frame adjacent a lower end of a leg thereof and at about two-thirds the height of said leg to permit springing of said leg frames.

12. A table as set forth in claim 8 wherein each leg frame is made of tubular metal and said table top is flat and is made of plastic.

13. A table comprising a plurality of U-shaped tubular metal leg frames defining a skeletal frame of rectangular shape, each leg frame including a horizontal tubular cross-bar having a longitudinally disposed recess therein with an overhanging lip along an upper edge;

a rectangular table top of self-supporting material supported on said leg frames, said table top having a peripheral edge supported on said cross-bars and disposed within each recess of a respective cross-bar with said lip of said cross-bar overhanging said peripheral edge; and wherein said leg frames are adapted to spring apart to permit entry of said table top into said recesses.

* * * * *

UNITED STATES PATENT AND TRADEMARK OFFICE

CERTIFICATE OF CORRECTION

PATENT NO. : 4,467,730

DATED : August 28, 1984

INVENTOR(S) : Donald J. Borichevsky

It is certified that error appears in the above-identified patent and that said Letters Patent is hereby corrected as shown below:

| Column | Line | Change From | To |
|---|---|---|---|
| 1 | 24 | Knockeddown | -knocked-down - |
| 3 | 16 | Fruther | -Further- |

Signed and Sealed this

*Twelfth* Day of *March 1985*

[SEAL]

*Attest:*

DONALD J. QUIGG

*Attesting Officer* *Acting Commissioner of Patents and Trademarks*